US009855599B2

(12) United States Patent
Cui et al.

(10) Patent No.: US 9,855,599 B2
(45) Date of Patent: Jan. 2, 2018

(54) CASTING METHODS AND ARTICLES

(71) Applicant: GENERAL ELECTRIC COMPANY, Schenectady, NY (US)

(72) Inventors: Yan Cui, Greer, SC (US); Srikanth Chandrudu Kottilingam, Simpsonville, SC (US); Matthew Laylock, Mauldin, SC (US); Dechao Lin, Greer, SC (US)

(73) Assignee: General Electric Company, Schenectady, NY (US)

( * ) Notice: Subject to any disclaimer, the term of this patent is extended or adjusted under 35 U.S.C. 154(b) by 101 days.

(21) Appl. No.: 14/941,627

(22) Filed: Nov. 15, 2015

(65) Prior Publication Data

US 2017/0136536 A1 May 18, 2017

(51) Int. Cl.
*B22D 19/16* (2006.01)
*B22D 27/04* (2006.01)
(Continued)

(52) U.S. Cl.
CPC ..... *B22D 27/045* (2013.01); *B22D 19/16* (2013.01); *F01D 5/28* (2013.01); *F01D 9/02* (2013.01);
(Continued)

(58) Field of Classification Search
CPC ..... B22D 19/16; B22D 27/04; B22D 27/045
(Continued)

(56) References Cited

U.S. PATENT DOCUMENTS 2,483,849 A * 10/1949 Seaman ..... B22D 19/16 164/92.1
3,486,833 A 12/1969 Miller et al.
(Continued)

FOREIGN PATENT DOCUMENTS

WO 2014093826 A2 6/2014
WO 2014133635 A2 9/2014
WO 2015148994 A2 10/2015

OTHER PUBLICATIONS

Jiang, Liang et al.; Development of Superalloy GTD262 at GE; Materials Design Approaches and Experiences III; 2012 TMS Annual Meeting & Exhibition; 2012.
(Continued)

*Primary Examiner* — Kevin P Kerns
(74) *Attorney, Agent, or Firm* — McNees Wallace & Nurick LLC

(57) ABSTRACT

Casting methods and articles are disclosed wherein a molten first material is introduced into a mold which distributes the first material to form a first region of the article where it is subjected to a first condition suitable for growing a first grain structure, forming the first region of the article. A molten second material, compositionally distinct from the first material, is introduced into the mold to form a second region of the article. A hybridized material is formed by intermixing a first portion of the second material with the second portion of the first material. A second portion of the second material is subjected to a second condition suitable for growing a second grain structure distinct from the first grain structure, forming the second region of the article. The first region and the second region are integrally formed as a single, continuous article with a hybridized region formed between.

20 Claims, 3 Drawing Sheets

(51) Int. Cl.

| | |
|---|---|
| ***F01D 5/28*** | (2006.01) |
| ***F01D 9/02*** | (2006.01) |
| ***F01D 9/04*** | (2006.01) |

(52) U.S. Cl.
CPC ..... *F01D 9/041* (2013.01); *F05D 2220/30* (2013.01); *F05D 2230/21* (2013.01); *F05D 2300/173* (2013.01); *F05D 2300/175* (2013.01); *F05D 2300/606* (2013.01); *F05D 2300/609* (2013.01)

(58) Field of Classification Search
USPC ..... 164/94, 95, 96, 122.1, 122.2
See application file for complete search history.

(56) References Cited

U.S. PATENT DOCUMENTS

| | | | |
|---|---|---|---|
| 3,627,015 | A | 12/1971 | Giamei et al. |
| 3,650,635 | A | 3/1972 | Wachtell et al. |
| 3,848,654 | A | 11/1974 | Boyle et al. |
| 5,071,054 | A | 12/1991 | Dzugan et al. |
| 5,161,950 | A | 11/1992 | Krueger et al. |
| 6,095,755 | A | 8/2000 | Houston |
| 2010/0059573 | A1 | 3/2010 | Kottilingam et al. |
| 2013/0086785 | A1 | 4/2013 | Cui et al. |
| 2014/0037981 | A1 | 2/2014 | Cui et al. |
| 2014/0342139 | A1 | 11/2014 | Cui et al. |

OTHER PUBLICATIONS

European Search Report and Opinion issued in connection with corresponding EP Application No. 6198934.8 dated Mar. 30, 2017.

* cited by examiner

CASTING METHODS AND ARTICLES

FIELD OF THE INVENTION

The present invention is directed to articles and methods for casting articles. More particularly, the present invention is directed to articles and methods for casting articles including two compositionally distinct materials having two distinct grain structures integrally formed as a single, continuous article.

BACKGROUND OF THE INVENTION

Hard-to-weld (HTW) alloys, such as nickel-based superalloys and certain aluminum-titanium alloys, due to their gamma prime and various geometric constraints, are susceptible to gamma prime strain aging, liquation and hot cracking. These materials are also difficult to join when the gamma prime phase is present in volume fractions greater than about 30%, which may occur when aluminum or titanium content exceeds about 3%.

These HTW materials may be incorporated into components of gas turbine engines such as airfoils, blades (buckets), nozzles (vanes), shrouds, combustors, rotating turbine components, wheels, seals, 3d-manufactured components with HTW alloys and other hot gas path components. During operation, components formed from HTW may be subjected to operating conditions which cause portions of the component to be worn down or damaged. By way of example, the tips of turbine airfoils such as blades (buckets) may be worn down over time, reducing efficiency of the turbine. Repairs of such wear are impaired by the difficulty in joining HTW materials, making standard repair techniques difficult. Rebuilding such components using hot processes such as laser cladding or conventional thermal spray yields deposited material which is weakened or cracked by the elevated temperatures. Brazing techniques are unsuitable because braze materials or elements are incorporated into the component which may not meet operational requirements.

Gas turbine components incorporating HTW materials tend to be more expensive than components formed from other materials, and certain HTW materials are more difficult to weld and more expensive than others. Incorporation of these HTW materials may be desirable due to often superior operational properties, particularly for certain portions of components subjected to the most extreme conditions and stresses, but difficulties in repairing gas turbine components with HTW materials may lead to components being discarded due to damage or defects which would otherwise be repairable in components formed from other materials, which is both wasteful and costly. However, the same properties which make HTW materials difficult to repair also make HTW materials difficult to join with other, less expensive and more easily reparable materials.

BRIEF DESCRIPTION OF THE INVENTION

In an exemplary embodiment, a casting method for forming an article includes introducing a first material into a mold. The first material is introduced in a molten state. The mold is arranged and disposed to preferentially distribute the first material to form a first region of the article. The first material is subjected to a first condition suitable for growing a first grain structure. The first grain structure is grown from a first portion of the first material, forming the first region of the article while maintaining a second portion of the first material in the molten state. A second material is introduced into the mold to form a second region of the article. The second material is introduced in the molten state. The second material is compositionally distinct from the first material. A hybridized material is formed by intermixing a first portion of the second material with the second portion of the first material. A second portion of the second material is subjected to a second condition suitable for growing a second grain structure. The second grain structure is distinct from the first grain structure. The second grain structure is grown from the second portion of the second material, forming the second region of the article. The first region and the second region are integrally formed as a single, continuous article with a hybridized region formed from the hybridized material disposed between the first region and the second region.

In another exemplary embodiment, a casting method for forming a turbine component includes introducing a first material into a mold. The first material is introduced in a molten state. The mold is arranged and disposed to preferentially distribute the first material to form a first region of the turbine component. The first material is subjected to a first condition suitable for growing a directionally solidified grain structure. The directionally solidified grain structure is grown from a first portion of the first material, forming the first region of the article while maintaining a second portion of the first material in the molten state. A second material is introduced into the mold to form a reduced-stress region of the turbine component. The second material is introduced in the molten state. The second material is compositionally distinct from the first material. A hybridized material is formed by intermixing a first portion of the second material with the second portion of the first material. A second portion of the second material is subjected to a second condition suitable for growing an equiaxed grain structure. The equiaxed grain structure is grown from the second portion of the second material, forming the reduced-stress region of the turbine component. The first region and the reduced-stress region are integrally formed as a single, continuous article with a hybridized region formed from the hybridized material disposed between the first region and the reduced-stress region.

In another exemplary embodiment, an article includes a first region, a second region and a hybridized region disposed between the first region and the second region. The first region includes a first material having a directionally solidified grain structure. The second region includes a second material having an equiaxed grain structure. The second material is compositionally distinct from the first material. The hybridized region includes a hybridized material, the hybridized material including intermixed first material and second material. The first region, the second region and the hybridized region are integrally formed as a single, continuous article. At least one of the first material and the second material is selected from the group consisting of HTW alloys.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary casting methods and articles. Embodiments of the present disclosure, in comparison to methods not utilizing one or more features disclosed herein, decrease costs, increase reparability, increase creep resistance, increase fatigue resistance, increase performance, improve component life, reduce life cycle costs, decrease waste, increase service intervals, increase material capability, improve mechanical properties, improve elevated temperature performance, increase weldability, or a combination thereof.

Figure 1:
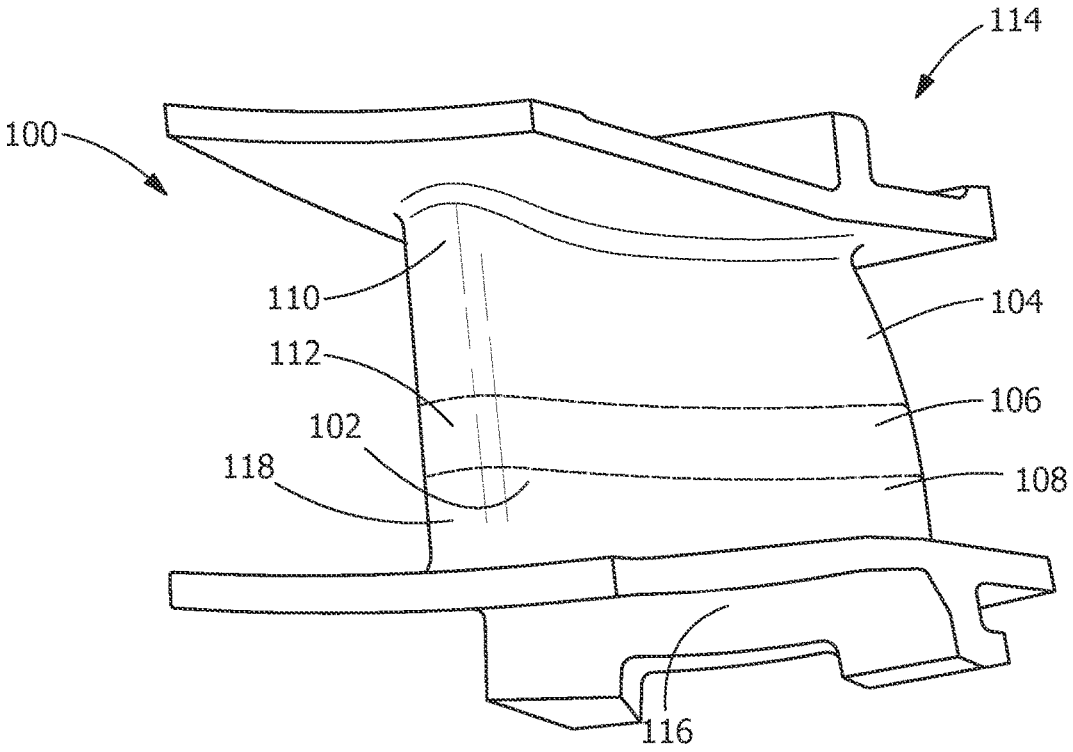
FIG. 1 is a perspective view of a portion of an article having an article, according to an embodiment of the present disclosure.

Referring to FIG. 1, in one embodiment an article 100 includes a first region 102, a second region 104 and a hybridized region 106 disposed between the first region 102 and the second region 104. The first region 102 includes a first material 108. The second region 104 includes a second material 110. The second material 110 is compositionally distinct from the first material 108. The hybridized region 106 includes a hybridized material 112. The hybridized material 112 includes intermixed first material 108 and second material 110. The first region 102, the second region 104 and the hybridized region 106 are integrally formed as a single, continuous article 100. In an alternate embodiment (not shown), the first region 102 and first material 108 are positionally exchanged with the second region 104 and the second material 110 in the article 100. The first region 102 and the first material 108 may be localized in any suitable area of the article 100, and the second region 104 and the second material 110 may be localized in any other suitable area of the article 100, provided that the hybridized region 106 including the hybridized material 112 is disposed between the first region 102 and the second region 104.

In one embodiment, the article 100 is a turbine component 114. The turbine component 114 may be any suitable turbine component 114, including, but not limited to, at least one of an airfoil, a nozzle (vane) (shown), a bucket (blade), a shroud, a combustion fuel nozzle, a hot gas path component, a combustor, a combustion transition piece, a combustion liner, a seal, a rotating component, a wheel, and a disk. In a further embodiment (shown), the first region 102 includes an outside wall 116 of a nozzle (vane) or a (blade) and a leading edge 118 of the nozzle (vane) or bucket (blade) adjacent to the outside wall 116 of the nozzle (vane) or bucket (blade). In an alternate further embodiment (not shown), the second region 104 includes an outside wall 116 of a nozzle (vane) or a (blade) and a leading edge 118 of the nozzle (vane) or bucket (blade) adjacent to the outside wall 116 of the nozzle (vane) or bucket (blade).

In one embodiment (shown), the first material 108 includes a directionally solidified grain structure, and the second material 110 includes an equiaxed grain structure. The first material 108 may compose up to about 70%, alternatively up to about 60%, alternatively up to about 50%, alternatively up to about 40%, alternatively up to about 30%, alternatively between about 15% and about 75%, alternatively between about 30% and about 60%, of the volume of the article 100. In a further embodiment, the second region 104 is a reduced-stress region, and the first material 108 of the first region 102 having the directionally solidified grain structure includes a property of reduced crack-susceptibility under operating conditions compared to a comparable first region 102 formed from the first material 108 having an equiaxed grain structure. As used herein, "reduced stress region" refers to a region of the article 100 which is subjected to reduced crack-causing stresses under operating conditions relative to another region.

In an alternate embodiment (not shown), the first material 108 includes an equiaxed grain structure, and the second material 110 includes a directionally solidified grain structure. The second material 110 may compose up to about 70%, alternatively up to about 60%, alternatively up to about 50%, alternatively up to about 40%, alternatively up to about 30%, alternatively between about 15% and about 75%, alternatively between about 30% and about 60%, of the volume of the article 100. In a further embodiment, the first region 102 is a reduced-stress region, and the second material 110 of the second region 104 having the directionally solidified grain structure includes a property of reduced crack-susceptibility under operating conditions compared to a comparable second region 104 formed from the second material 110 having an equiaxed grain structure.

The property of reduced crack-susceptibility may include any suitable property, including, but not limited to, increasing creep resistance, increasing fatigue resistance, increasing operating life of the turbine component, or a combination thereof.

In one embodiment, at least one of the first material 108 and the second material 110 is a HTW alloy. As used herein, an "HTW alloy" is an alloy which exhibits liquation, hot and strain-age cracking, and which is therefore impractical to weld. In a further embodiment, the HTW alloy is a superalloy. In yet a further embodiment, the HTW alloy is a nickel-based superalloy or aluminum-titanium superalloy. HTW alloys include, but are not limited to, René 108, GTD 111, GTD 444, René N2, and INCONEL 738.

In one embodiment (shown), the first material 108 is any suitable material, including, but not limited to, at least one of René 108, GTD 111, GTD 444, René N2, and INCONEL 738, and the second material 110 is any suitable material, including, but not limited to, at least one of GTD 262, GTD 222, and GTD 241. In an alternate embodiment (now shown), the first material 108 is any suitable material, including, but not limited to, at least one of GTD 262, GTD 222, and GTD 241, and the second material 110 is any suitable material, including, but not limited to, at least one of René 108, GTD 111, GTD 444, René N2, and INCONEL 738.

As used herein, "GTD 111" refers to an alloy including a composition, by weight, of about 14% chromium, about 9.5% cobalt, about 3.8% tungsten, about 4.9% titanium, about 3% aluminum, about 0.1% iron, about 2.8% tantalum, about 1.6% molybdenum, about 0.1% carbon, and a balance of nickel.

As used herein, "GTD 222" refers to an alloy including a composition, by weight, of about 23.5% chromium, about 19% cobalt, about 2% tungsten, about 0.8% niobium, about 2.3% titanium, about 1.2% aluminum, about 1% tantalum, about 0.25% silicon, about 0.1% manganese, and a balance of nickel.

As used herein, "GTD 241" refers to an alloy including a composition, by weight, of about 22.5% chromium, about 19% cobalt, about 2% tungsten, about 1.35% niobium, about 2.3% titanium, about 1.2% aluminum, about 0.1% carbon, and a balance of nickel.

As used herein, "GTD 262" refers to an alloy including a composition, by weight, of about 22.5% chromium, about 19% cobalt, about 2% tungsten, about 1.35% niobium, about 2.3% titanium, about 1.7% aluminum, about 0.1% carbon, and a balance of nickel.

As used herein, "GTD 444" refers to an alloy including a composition, by weight, of about 7.5% cobalt, about 0.2% iron, about 9.75% chromium, about 4.2% aluminum, about 3.5% titanium, about 4.8% tantalum, about 6% tungsten, about 1.5% molybdenum, about 0.5% niobium, about 0.2% silicon, about 0.15% hafnium, and a balance of nickel.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "René N2" refers to an alloy including a composition, by weight, of about 7.5% cobalt, about 13% chromium, about 6.6% aluminum, about 5% tantalum, about 3.8% tungsten, about 1.6% rhenium, about 0.15% hafnium, and a balance of nickel.

As used herein, "René 108" refers to an alloy including a composition, by weight, of about 8.4% chromium, about 9.5% cobalt, about 5.5% aluminum, about 0.7% titanium, about 9.5% tungsten, about 0.5% molybdenum, about 3% tantalum, about 1.5% hafnium, and a balance of nickel.

Figure 2:
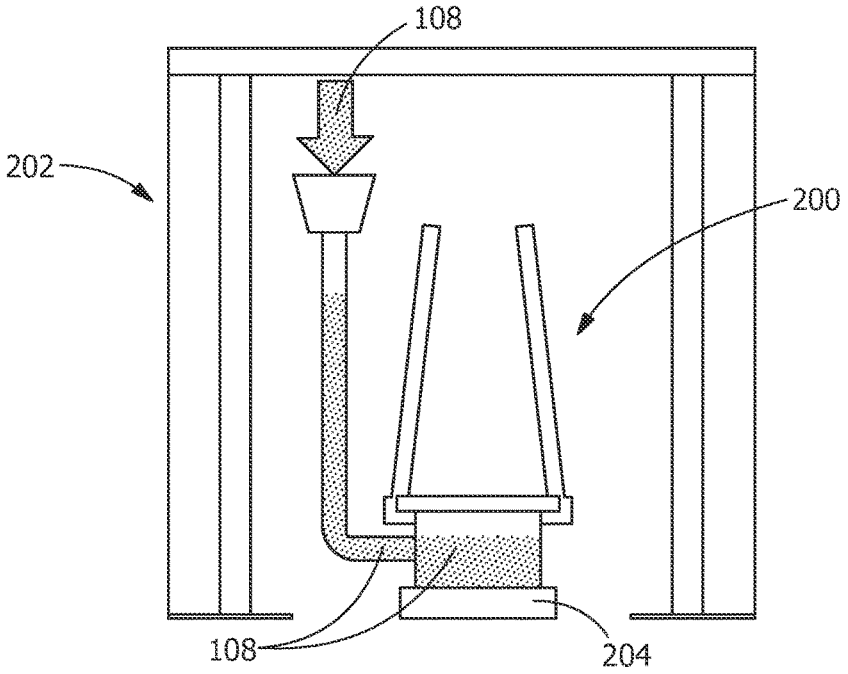
FIG. 2 is a schematic view of a mold into which a molten first material has been introduced, according to an embodiment of the present disclosure.

Referring to FIG. 2, in one embodiment, a casting method for forming the article 100 includes introducing the first material 108 into a mold 200. The mold 200 may be heated by any suitable heating device, including, but not limited to, an oven 202. The mold 200 may also be disposed in proximity to, or attached to, a cooling apparatus, such as, but not limited to, a chill plate 204. The first material 108 may be introduced in a molten state. The mold 200 is arranged and disposed to preferentially distribute the first material 108 to form a first region 102 of the article 100.

Figure 3:
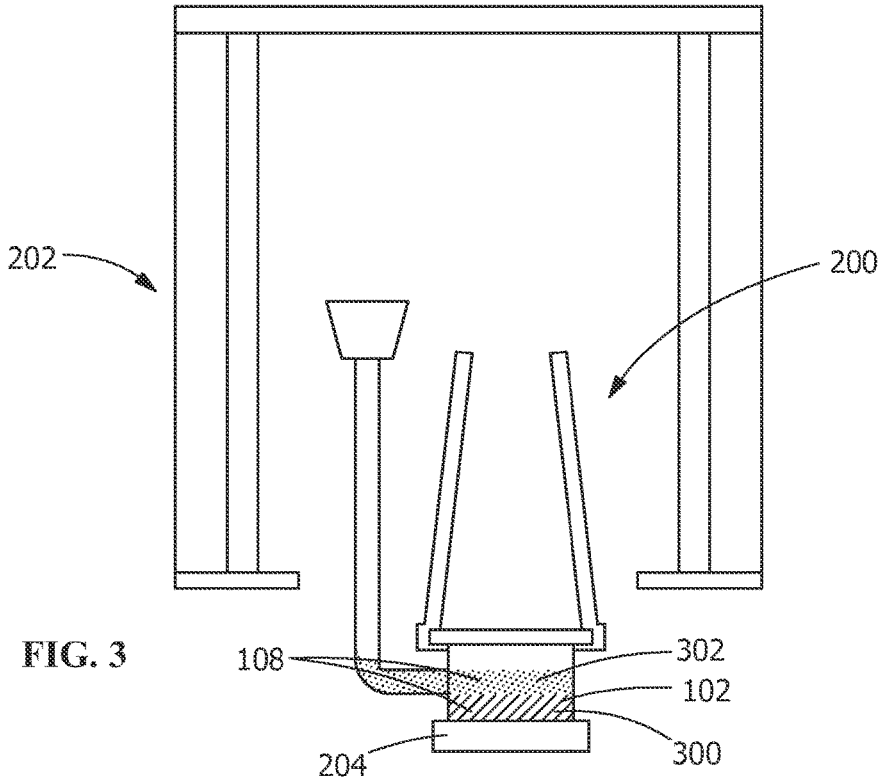
FIG. 3 is a schematic view of the mold of FIG. 2 following growth of a first grain structure from a first portion of the first material, according to an embodiment of the present disclosure.

Referring to FIG. 3, in one embodiment, the first material 108, disposed in the mold 200 in a molten state, is subjected to a first condition suitable for growing a first grain structure. The first grain structure is grown from a first portion 300 of the first material, forming the first region 102 of the article while maintaining a second portion 302 of the first material 108 in the molten state. In one embodiment (shown), the first grain structure is a directionally solidified grain structure. In an alternate embodiment (not shown), the first grain structure is an equiaxed grain structure.

Figure 4:
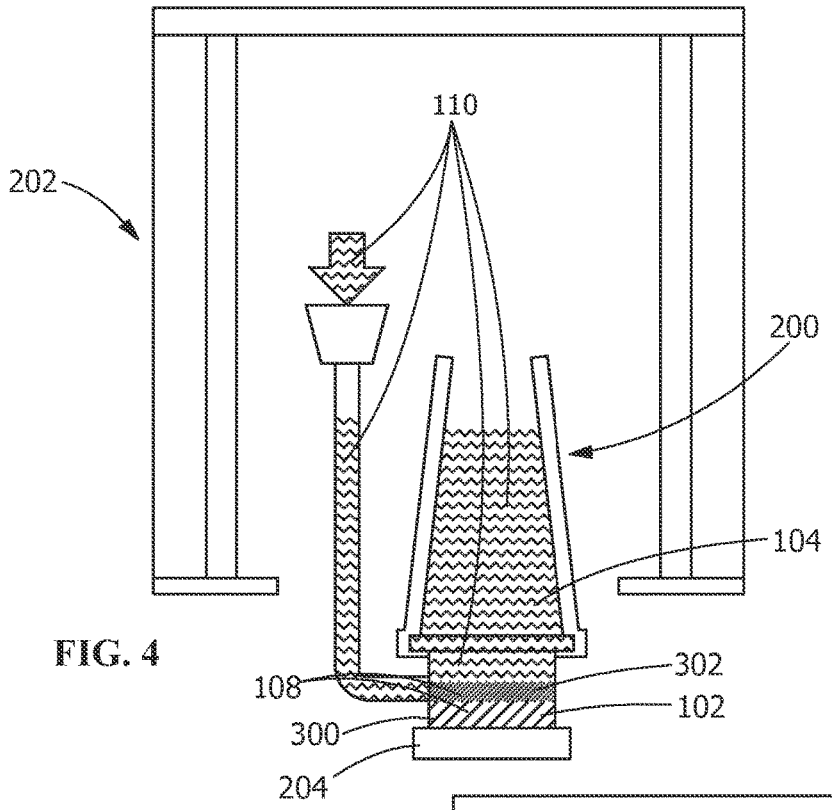
FIG. 4 is a schematic view of the mold of FIG. 3 into which a molten second material has been introduced, according to an embodiment of the present disclosure.

Referring to FIG. 4, in one embodiment, a second material 110 is introduced into the mold 200, the mold having the first portion 300 of the first material 108 with the first grain structure and the second portion 302 of the first material 108 being maintained in the molten state, to form the second region 104 of the article 100. The second material 110 is introduced in the molten state.

Figure 5:
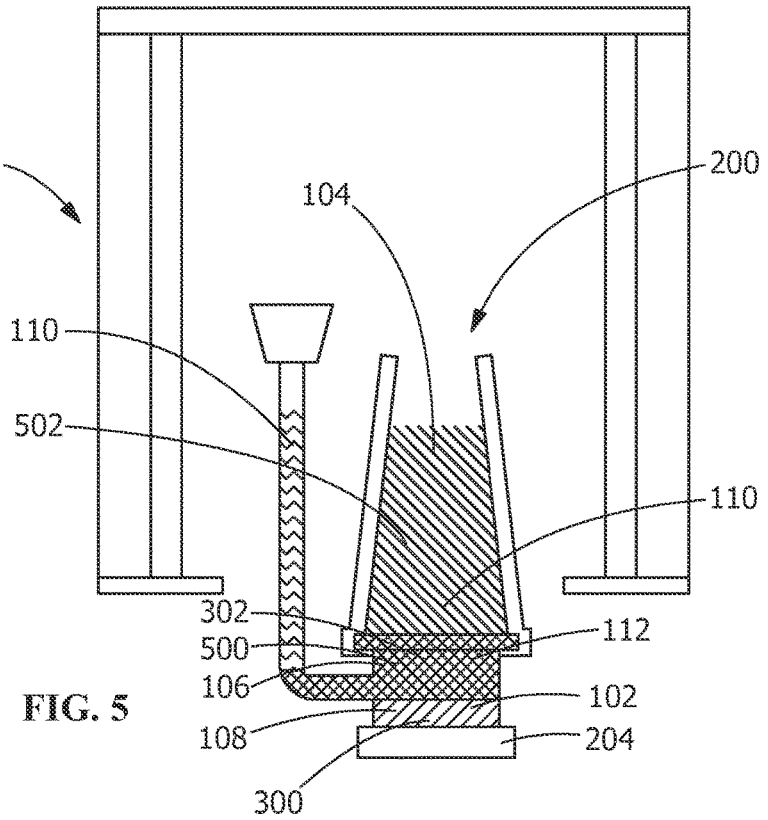
FIG. 5 is a schematic view of a mold of FIG. 4 following growth of a second grain structure from a second portion of the second material, according to an embodiment of the present disclosure.

Referring to FIG. 5, in one embodiment, a hybridized material 112 is formed by intermixing a first portion 500 of the second material 110 with the second portion 302 of the first material 108. A second portion 502 of the second material 110 is subjected to a second condition suitable for growing a second grain structure. The second grain structure is distinct from the first grain structure. The second grain structure is grown from the second portion 502 of the second material 110, forming the second region 104 of the article 100. The first region 102 and the second region 104 are integrally formed as a single, continuous article 100 with the hybridized region 106 disposed between the first region 102 and the second region 104. In one embodiment (shown), the second grain structure is an equiaxed grain structure. In an alternate embodiment (not shown), the second grain structure is a directionally solidified grain structure.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A casting method for forming an article, comprising:

introducing a first material into a mold, the first material being introduced in a molten state, the mold being arranged and disposed to preferentially distribute the first material to form a first region of the article;

subjecting the first material to a first condition suitable for growing a first grain structure;

growing the first grain structure from a first portion of the first material, forming the first region of the article while maintaining a second portion of the first material in the molten state;

introducing a second material into the mold to form a second region of the article, the second material being introduced in the molten state, the second material being compositionally distinct from the first material;

forming a hybridized material by intermixing a first portion of the second material with the second portion of the first material;

subjecting a second portion of the second material to a second condition suitable for growing a second grain structure, the second grain structure being distinct from the first grain structure; and growing the second grain structure from the second portion of the second material, forming the second region of the article, the first region and the second region being integrally formed as a single, continuous article with a hybridized region formed from the hybridized material and disposed between the first region and the second region, wherein one of the first material and the second material is a hard-to-weld (HTW) alloy, the HTW alloy being a superalloy, and the other of the first material and the second material is selected from the group consisting of:

a first alloy including a composition, by weight, of about 22.5% chromium, about 19% cobalt, about 2% tungsten, about 1.35% niobium, about 2.3% titanium, about 1.7% aluminum, about 0.1% carbon, and a balance of nickel;

a second alloy including a composition, by weight, of about 23.5% chromium, about 19% cobalt, about 2% tungsten, about 0.8% niobium, about 2.3% titanium, about 1.2% aluminum, about 1% tantalum, about 0.25% silicon, about 0.1% manganese, and a balance of nickel;

a third alloy including a composition, by weight, of about 22.5% chromium, about 19% cobalt, about 2% tungsten, about 1.35% niobium, about 2.3% titanium, about 1.2% aluminum, about 0.1% carbon, and a balance of nickel; and combinations thereof.

2. The casting method of claim 1, wherein the HTW alloy is selected from the group consisting of:

a fourth alloy including a composition, by weight, of about 8.4% chromium, about 9.5% cobalt, about 5.5% aluminum, about 0.7% titanium, about 9.5% tungsten, about 0.5% molybdenum, about 3% tantalum, about 1.5% hafnium, and a balance of nickel;

a fifth alloy including a composition, by weight, of about 14% chromium, about 9.5% cobalt, about 3.8% tungsten, about 4.9% titanium, about 3% aluminum, about 0.1% iron, about 2.8% tantalum, about 1.6% molybdenum, about 0.1% carbon, and a balance of nickel;

a sixth alloy including a composition, by weight, of about 7.5% cobalt, about 0.2% iron, about 9.75% chromium, about 4.2% aluminum, about 3.5% titanium, about 4.8% tantalum, about 6% tungsten, about 1.5% molybdenum, about 0.5% niobium, about 0.2% silicon, about 0.15% hafnium, and a balance of nickel;

a seventh alloy including a composition, by weight, of about 7.5% cobalt, about 13% chromium, about 6.6% aluminum, about 5% tantalum, about 3.8% tungsten, about 1.6% rhenium, about 0.15% hafnium, and a balance of nickel;

an eighth alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel; and combinations thereof.

3. The casting method of claim 2, wherein the HTW alloy is the fourth alloy, and the other of the first material and second material is the first alloy.

4. The casting method of claim 2, wherein the HTW alloy is the fourth alloy, and the other of the first material and second material is the second alloy.

5. The casting method of claim 2, wherein the HTW alloy is the fourth alloy, and the other of the first material and second material is the third alloy.

6. The casting method of claim 2, wherein the HTW alloy is the fifth alloy, and the other of the first material and second material is the first alloy.

7. The casting method of claim 1, wherein forming the first region and the second region includes forming a reduced-stress region.

8. The casting method of claim 1, wherein growing the first grain structure and the second grain structure includes growing a directionally solidified grain structure and an equiaxed grain structure.

9. The casting method of claim 1, wherein forming the article includes forming a turbine component.

10. The casting method of claim 9, wherein forming the turbine component includes forming at least one of a nozzle (vane) and a bucket (blade).

11. The casting method of claim 10, wherein forming the first region includes forming an outside wall of the nozzle (vane) or bucket (blade) and a leading edge of the nozzle (vane) or bucket (blade) adjacent to the outside wall of the nozzle (vane) or bucket (blade).

12. The casting method of claim 1, wherein the first material is the HTW alloy and the second material is selected from the group consisting of:

a first alloy including a composition, by weight, of about 22.5% chromium, about 19% cobalt, about 2% tungsten, about 1.35% niobium, about 2.3% titanium, about 1.7% aluminum, about 0.1% carbon, and a balance of nickel;

a second alloy including a composition, by weight, of about 23.5% chromium, about 19% cobalt, about 2% tungsten, about 0.8% niobium, about 2.3% titanium, about 1.2% aluminum, about 1% tantalum, about 0.25% silicon, about 0.1% manganese, and a balance of nickel;

a third alloy including a composition, by weight, of about 22.5% chromium, about 19% cobalt, about 2% tungsten, about 1.35% niobium, about 2.3% titanium, about 1.2% aluminum, about 0.1% carbon, and a balance of nickel; and combinations thereof.

13. The casting method of claim 1, wherein the second material is the HTW alloy and the first material is selected from the group consisting of:

a first alloy including a composition, by weight, of about 22.5% chromium, about 19% cobalt, about 2% tungsten, about 1.35% niobium, about 2.3% titanium, about 1.7% aluminum, about 0.1% carbon, and a balance of nickel;

a second alloy including a composition, by weight, of about 23.5% chromium, about 19% cobalt, about 2% tungsten, about 0.8% niobium, about 2.3% titanium, about 1.2% aluminum, about 1% tantalum, about 0.25% silicon, about 0.1% manganese, and a balance of nickel;

a third alloy including a composition, by weight, of about 22.5% chromium, about 19% cobalt, about 2% tungsten, about 1.35% niobium, about 2.3% titanium, about 1.2% aluminum, about 0.1% carbon, and a balance of nickel; and combinations thereof.

14. A casting method for forming a turbine component, comprising:

introducing a first material into a mold, the first material being introduced in a molten state, the mold being arranged and disposed to preferentially distribute the first material to form a first region of the turbine component;

subjecting the first material to a first condition suitable for growing a directionally solidified grain structure;

growing the directionally solidified grain structure from a first portion of the first material, forming the first region of the turbine component while maintaining a second portion of the first material in the molten state;

introducing a second material into the mold to form a reduced-stress region of the turbine component, the second material being introduced in the molten state, the second material being compositionally distinct from the first material;

forming a hybridized material by intermixing a first portion of the second material with the second portion of the first material;

subjecting a second portion of the second material to a second condition suitable for growing an equiaxed grain structure; and growing the equiaxed grain structure from the second portion of the second material, forming the reduced-stress region of the turbine component, the first region and the reduced-stress region being integrally formed as a single, continuous article with a hybridized region formed from the hybridized material and disposed between the first region and the reduced-stress region, wherein the first material is a hard-to-weld (HTW) alloy, the HTW alloy being a superalloy, and the second material is selected from the group consisting of:

a first alloy including a composition, by weight, of about 22.5% chromium, about 19% cobalt, about 2% tungsten, about 1.35% niobium, about 2.3% titanium, about 1.7% aluminum, about 0.1% carbon, and a balance of nickel;

a second alloy including a composition, by weight, of about 23.5% chromium, about 19% cobalt, about 2% tungsten, about 0.8% niobium, about 2.3% titanium, about 1.2% aluminum, about 1% tantalum, about 0.25% silicon, about 0.1% manganese, and a balance of nickel;

a third alloy including a composition, by weight, of about 22.5% chromium, about 19% cobalt, about 2% tungsten, about 1.35% niobium, about 2.3% titanium, about 1.2% aluminum, about 0.1% carbon, and a balance of nickel; and combinations thereof.

15. The casting method of claim 14, wherein introducing the HTW alloy is selected from the group consisting of:

a fourth alloy including a composition, by weight, of about 8.4% chromium, about 9.5% cobalt, about 5.5% aluminum, about 0.7% titanium, about 9.5% tungsten, about 0.5% molybdenum, about 3% tantalum, about 1.5% hafnium, and a balance of nickel;

a fifth alloy including a composition, by weight, of about 14% chromium, about 9.5% cobalt, about 3.8% tungsten, about 4.9% titanium, about 3% aluminum, about 0.1% iron, about 2.8% tantalum, about 1.6% molybdenum, about 0.1% carbon, and a balance of nickel;

a sixth alloy including a composition, by weight, of about 7.5% cobalt, about 0.2% iron, about 9.75% chromium, about 4.2% aluminum, about 3.5% titanium, about 4.8% tantalum, about 6% tungsten, about 1.5% molybdenum, about 0.5% niobium, about 0.2% silicon, about 0.15% hafnium, and a balance of nickel;

a seventh alloy including a composition, by weight, of about 7.5% cobalt, about 13% chromium, about 6.6% aluminum, about 5% tantalum, about 3.8% tungsten, about 1.6% rhenium, about 0.15% hafnium, and a balance of nickel;

an eighth alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel; and combinations thereof.

16. The casting method of claim 15, wherein the HTW alloy is the fourth alloy, and the second material is the first alloy.

17. The casting method of claim 14, wherein forming the turbine component includes forming at least one of a nozzle (vane) and a bucket (blade).

18. The casting method of claim 17, wherein forming the first region includes forming an outside wall of the nozzle (vane) or bucket (blade) and a leading edge of the nozzle (vane) or bucket (blade) adjacent to the outside wall of the nozzle (vane) or bucket (blade).

19. The casting method of claim 14, wherein forming the first region of the turbine component from the first material having the directionally solidified grain structure develops a property of reduced crack-susceptibility under operating conditions compared to a comparable first region formed from the first material having the equiaxed grain structure.

20. The casting method of claim 19, wherein developing the property of reduced crack-susceptibility includes at least one of increasing creep resistance, increasing fatigue resistance, and increasing operating life of the turbine component.

* * * * *